United States Patent [19]

Scott

[11] 4,192,236

[45] Mar. 11, 1980

[54] FIRING MECHANISM FOR PERCUSSION CAPS

[75] Inventor: Andrew M. Scott, Wiltshire, England

[73] Assignee: Wallop Industries Limited, Stockbridge, England

[21] Appl. No.: 897,158

[22] Filed: Apr. 17, 1978

Related U.S. Application Data

[63] Continuation-in-part of Ser. No. 773,116, Feb. 28, 1977, abandoned.

[30] Foreign Application Priority Data

Mar. 4, 1976 [GB] United Kingdom ..... 8791/76

[51] Int. Cl.[2] ..... F42C 7/00; F42B 3/10; F42C 15/06

[52] U.S. Cl. ..... 102/261; 42/1 Z; 89/1 B; 89/1.813

[58] Field of Search ..... 42/1 H, 1 Z, 1 G; 102/260, 261, 274, 37.8, 37.4; 89/27 R, 1.813

[56] References Cited

U.S. PATENT DOCUMENTS

| | | | |
|---|---|---|---|
| 975,720 | 11/1910 | Risser | 42/1 J |
| 1,815,226 | 7/1931 | Anderson | 102/7 X |
| 2,042,934 | 6/1936 | Gill | 42/1 G |
| 2,075,813 | 4/1937 | King | 102/70 R |
| 2,889,653 | 6/1959 | Clauser et al. | 42/1 Z |
| 2,937,831 | 5/1960 | Mayo et al. | 102/85.6 X |
| 2,996,989 | 8/1961 | Grandy | 102/261 |
| 3,315,397 | 4/1967 | Gilliam et al. | 42/1 Z |
| 3,392,672 | 7/1968 | Noles | 102/261 X |
| 3,505,959 | 4/1970 | Lohnert et al. | 102/70 R |
| 3,619,927 | 11/1971 | Robinet | 89/1 B X |
| 3,640,012 | 2/1972 | Schermuly | 89/1 B X |
| 3,665,630 | 5/1972 | Taylor | 89/1 B X |
| 3,685,451 | 8/1972 | Bowring | 102/70 R |
| 3,771,456 | 11/1973 | Klasons et al. | 102/70 R |
| 3,971,319 | 7/1976 | Larson | 102/70 R X |

FOREIGN PATENT DOCUMENTS

| | | | |
|---|---|---|---|
| 1228165 | 10/1962 | Fed. Rep. of Germany | 102/261 |

*Primary Examiner*—David H. Brown

*Attorney, Agent, or Firm*—Wenderoth, Lind & Ponack

[57] ABSTRACT

A firing mechanism for a percussion cap for a pyrotechnic device in which a firing pin is mounted on the underside of a leaf spring. The spring is normally unstressed but can be drawn back and stressed by manual withdrawal of a device engaged beneath the spring. Release of the stressed spring brings down the firing pin on the percussion cap to fire it.

22 Claims, 13 Drawing Figures

FIRING MECHANISM FOR PERCUSSION CAPS

This application is a continuation-in-part of my application Ser. No. 773,116, filed Feb. 28th, 1977, now abandoned, and the invention relates to a firing mechanism for firing a percussion cap, as may be used to activate a pyrotechnic device, fire extinguisher or pressure inflator or rocket or the like.

BACKGROUND AND SUMMARY OF THE INVENTION

The object of the invention is to provide a simple and compact firing mechanism.

According to the invention there is provided a firing mechanism for firing a percussion cap. The mechanism includes a percussion cap support having a position in which the percussion cap is located, a leaf spring fixed at one end thereof to the support and extending across the percussion cap position, a firing pin protruding from one side of the leaf spring towards the percussion cap, a mass disposed on the leaf spring to back up the firing pin, an engagement device engaged under the leaf spring, on the firing pin side of the leaf spring and at the end thereof opposite from the fixed end for preventing access of the firing pin to the percussion cap when in the rest position prior to firing, and means for withdrawing the engagement device to fire the percussion cap, the withdrawal means being manually actuable to move the engagement device, thereby flexing the spring, to a certain position, whereat the engaged end clears the engagement device and there is sufficient energy stored in the spring by flexure that on release of the spring it drives the firing pin into and fires the cap.

In preferred embodiments the spring is lightly stressed against the engagement device when in the rest position, but the energy stored in the spring is insufficient to fire the percussion cap in the event of breakage of the engagement device. In this way accidental firing can be avoided even in the event that the device is dropped or broken.

The engagement device may be a mass, for example a ball or other shape having a cord or handle attached. The mass normally rests beneath the spring and withdrawing it by means of a handle or cord stresses the spring which is then released to fire the percussion cap as the mass is drawn past. The mass may be discarded.

However, in a preferred embodiment of the invention the engagement device is a lever which has a catch portion which engages beneath the the other end of the leaf spring, the lever being manually operable to raise the spring until the catch portion clears it to release the spring and fire the percussion cap.

Preferably, the lever is rigid and is pivoted with respect to the housing. With this arrangement there may be an extension of the lever beyond the fulcrum which can be depressed to urge the lever proper upwardly. However, it is envisaged that there may be no extension beyond the fulcrum and the lever is simply raised manually. The latter arrangement allows a modification in which the lever is flexible or has a flexible portion and is mounted rigidly on the housing as by welding or riveting, flexure of the lever or a hinge portion thereof allowing the required upward movement.

Preferably the lever is aligned with the leaf spring and the fulcrum or fixture point for the lever may then be over the fixture point for the spring or at a place in the housing directly opposite. However, the lever need not be aligned with the leaf spring and the point of fixture or fulcrum can be any desired position.

The catch portion may be a catch depending from the lever to engage beneath the spring. Alternatively, it may be constituted by part of the lever itself which normally rests beneath the end of the spring.

In another preferred embodiment, the firing mechanism further comprises location means for locating the percussion cap support, flexure stress in the spring being reacted via the percussion cap support to the location means during withdrawal of the engagement device to fire the percussion cap.

The invention also provides a rocket and launcher combination comprising a percussion cap, a rocket jet plate having a position wherein the percussion cap is supported, a leaf spring fixed at one end thereof to the rocket jet plate and extending across the percussion cap position, a firing pin protruding from one side of the leaf spring towards the percussion cap; a mass disposed on the leaf spring to back up the firing pin; a rocket body having the rocket jet plate at one end thereof, a rocket launcher at least partially surrounding the rocket body, an engagement device provided in the rocket launcher engaged under the leaf spring, on the firing pin side of the spring and at the end thereof opposite from the fixed end for preventing access of the firing pin to the percussion cap when in the rest position prior to firing, abutment means in the rocket launcher for the rocket jet plate to abut against prior to firing, and means in the rocket launcher for withdrawing the engagement device to fire the percussion cap, the withdrawal means being manually actuable to move the engagement device, thereby flexing the spring, flexure stress in the spring being reacted via the rocket jet plate to the abutment means and the rocket launcher, to a certain position wherein the engaged end clears the engagement device and there is sufficient energy stored in the spring by flexure that on release of the spring it drives the firing pin into and fires the cap.

BRIEF DESCRIPTION OF THE DRAWINGS

The invention will further be described with reference to the accompanying drawings, of which.

DETAILED DESCRIPTION OF THE INVENTION

Figure 1:
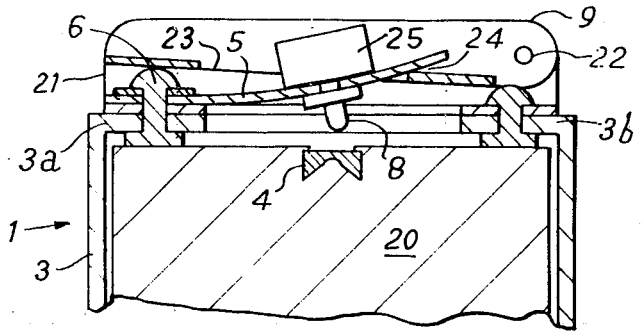
FIGS. 1 to 3 are cross-sectional diagrams of a firing mechanism in accordance with the invention showing respectively three successive stages in the firing of the mechanism.
Figure 2:
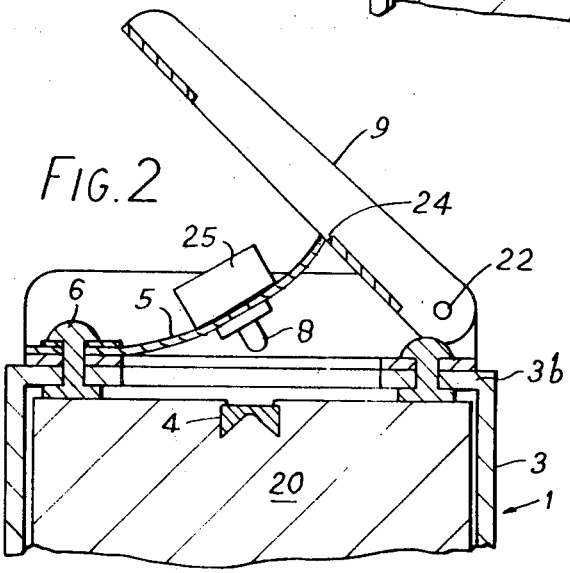
Figure 3:
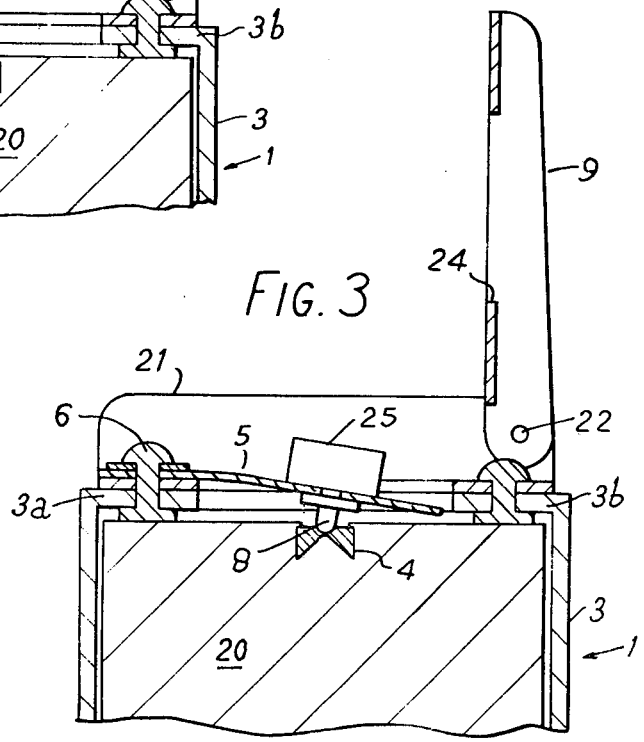
Figure 4:
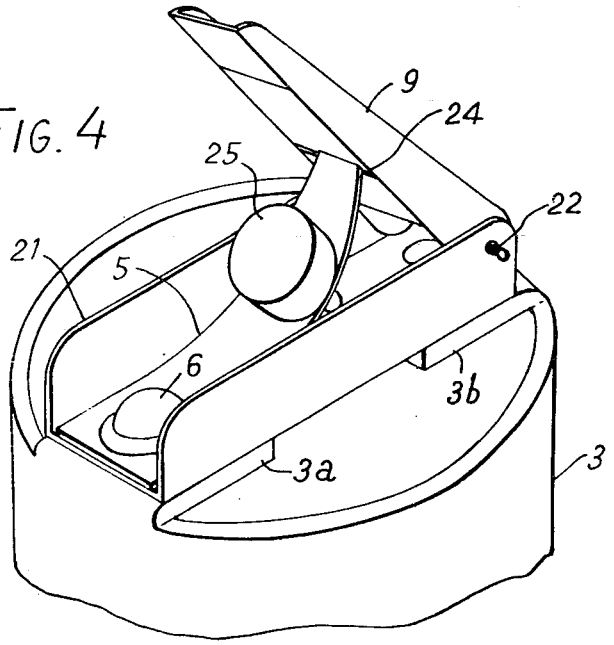
FIG. 4 is a perspective view of the mechanism when in the position depicted in FIG. 2.

Referring to FIGS. 1 to 4, the mechanism comprises a housing 1 constituted by a cylindrical casing having a wall 3 with lugs 3*a*, 3*b* bent inwardly towards each other across the top. A pyrotechnic charge 20 is fired by striking a percussion cap 4. A channel-section support 21 holds the firing mechanism. A steel leaf spring 5 is riveted at one end 6, together with the support 21, to lug 3*a*. The support is also riveted to the lug 3*b*.

An operating lever 9 is pivoted in the support 21 by means of a pin 22 and has a cut-out 23 which presents a lip 24. Lip 24 normally rests under the free end of spring 5, as shown in FIG. 1. In the rest position of lever 9 the lip 24 engages the spring 5 so as to stress the spring lightly. The firing pin is thus held from the percussion cap 4. The arrangement is such that the spring is not stressed sufficiently to store enough energy to fire the cap in the event that the lip breaks, for example. In this way accidental firing is avoided even if the device is dropped or the lip 24 breaks.

The spring carries on its underside a striker pin 8 and mounted above the striker pin is a weight 25. In the rest position shown in FIG. 1, the weight 25 is accomodated in the cut-out 23. To fire the device the arm 9 is raised. At the position shown in FIGS. 2 and 4 the spring 5 has been stressed and its end is about to clear lip 24. Further upward movement of the arm releases the spring so that the firing pin is brought down by the spring to strike the cap 4.

Figure 5:
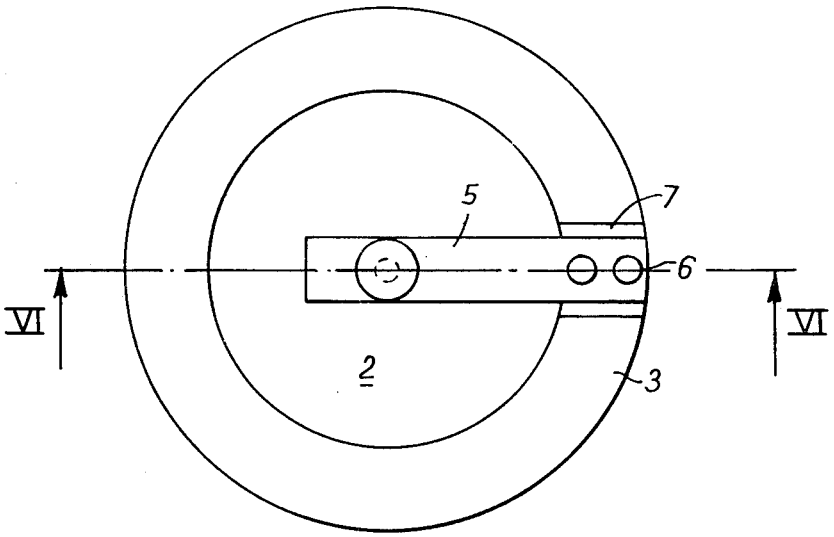
FIG. 5 is a plan view of a firing mechanism in accordance with another embodiment of the invention with the operating lever removed.
Figure 6:
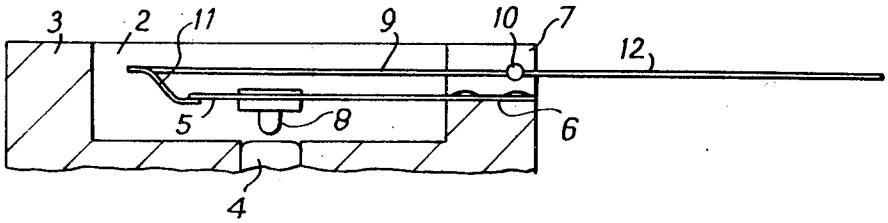
FIG. 6 is a cross-sectional view taken at along line VI-VI of FIG. 5 with the lever in place.

Referring to FIGS. 5 and 6 there is shown another mechanism in accordance with the invention which comprises a housing 1 which is cylindrical and which has a cylindrical cavity 2 in the top defined by an annular wall 3. At the bottom of the cavity in the centre is the percussion cap 4. The steel leaf spring 5 is riveted at one end 6 in the base of a cut-out 7 in the wall 3. Near its other end the spring carries on its underside the striker pin 8. The spring is shown in its unstressed condition in FIG. 6.

Figure 7:
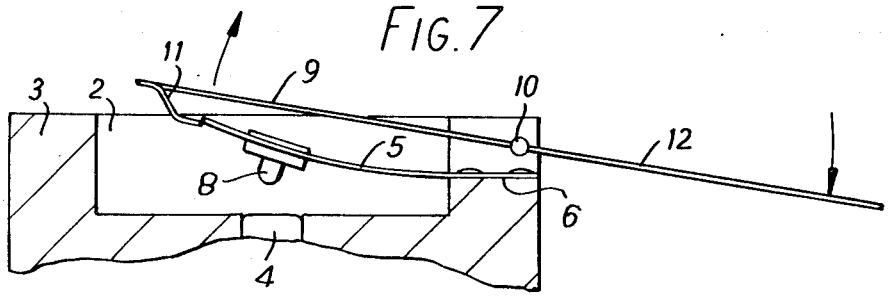
FIG. 7 is a view similar to FIG. 6 showing the operation of the mechanism.

The operating lever 9 is pivoted by means of a pivot pin 10 in the cut-out 7. A catch 11 depends from the end of the lever and engages beneath the free end of spring 5. The lever has an extension 12 beyond the fulcrum of pin 10 and depression of the extension raises the lever and thus draws with it the spring 5, so stressing the spring, until the point shown in FIG. 7 is reached. At this point the catch clears the end of the spring, the spring is released and the firing pin strikes the percussion cap to fire it.

Figure 8:
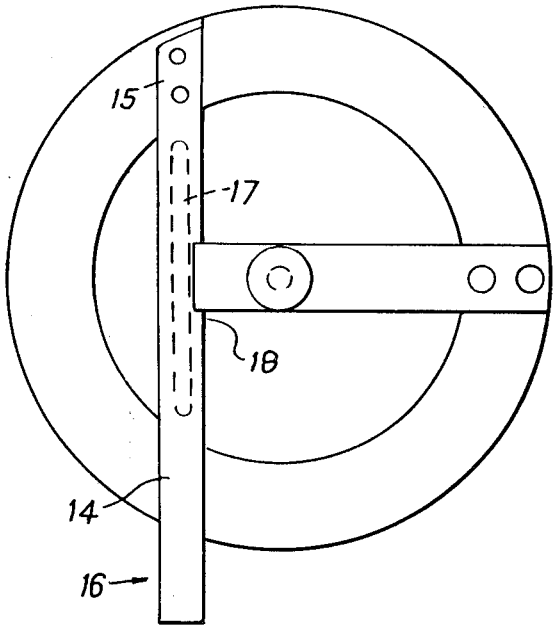
FIG. 8 is a plan view of another embodiment of the invention.
Figure 9:
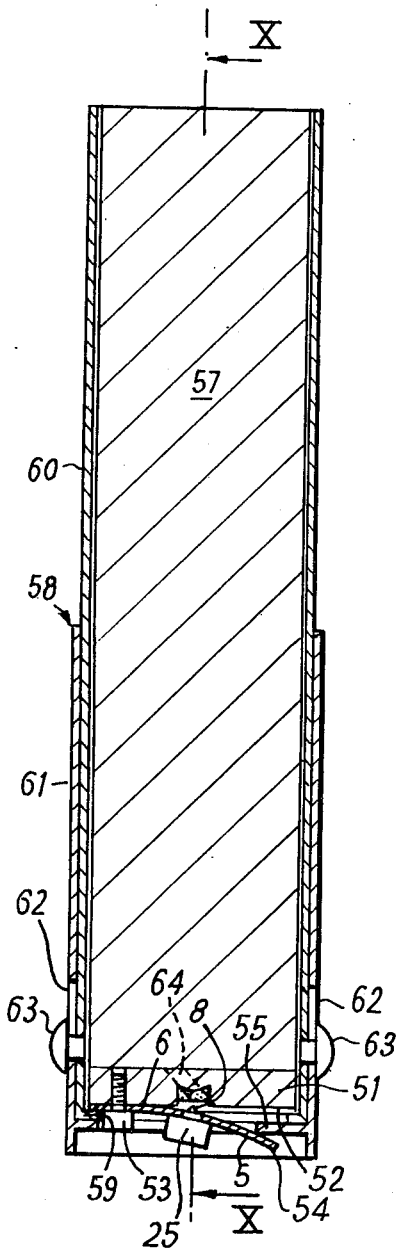
FIG. 9 is a cross-section along the length of a rocket and launcher incorporating a firing mechanism according to the invention.
Figure 10:
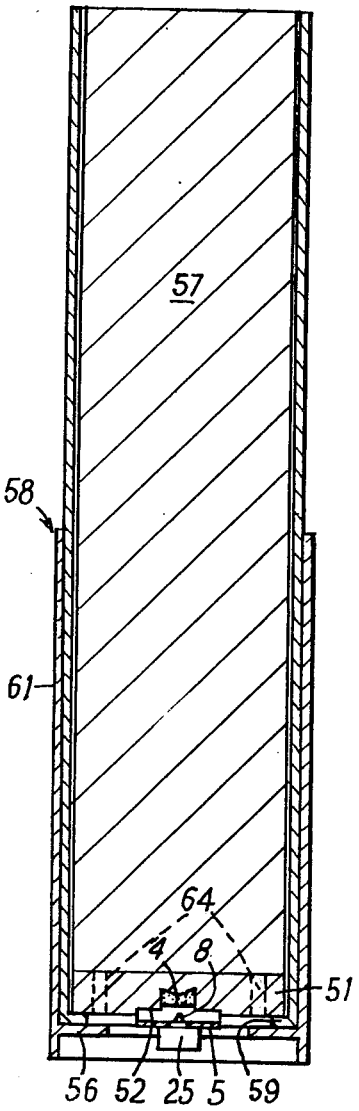
FIG. 10 is a cross-section similar to that of FIG. 9 but taken at 90° to the section of FIG. 9 along line X-X in FIG. 9.
Figure 11:
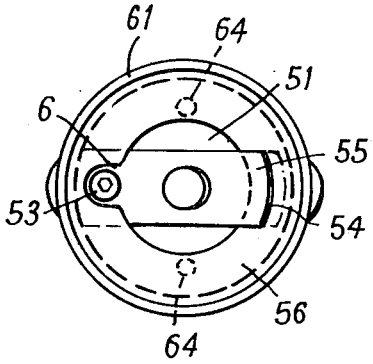
FIG. 11 is a bottom view of the rocket and launcher of FIG. 9.

Referring now to FIG. 8, there is shown an alternative mechanism in accordance with the invention. In this arrangement the leaf spring 5 is mounted on the top of the wall 3, the wall being consequently lower than in FIGS. 5 to 7. The operating lever comprises a strip 14 of plastics material ribeted at 15 to the top of wall 3 and projecting beyond the wall at the other side 16. The strip 14 is basically flat but there is a strengthening rib 17 on its underside at its central region. The catch portion of the lever is the side of the lever at 18, which is normally located underneath the free end of the leaf spring, as shown in FIG. 8.

Raising the free end of the strip at 16 lifts the leaf spring until it clears the side 18 of the strip, when it is released to fire the cap.

Referring now to FIGS. 9 to 12, the firing mechanism is arranged to fire a cap 4 supported in a position in a rocket jet or choke plate 51. Fixed to the jet plate is a leaf spring 5 with a firing pin 8 protruding therefrom towards the cap 4. The firing pin is riveted to the leaf spring and integral with a mass 25 disposed on the other side of the spring to back up the firing pin.

To positively align the firing pin with the cap, the fixed end 6 of the spring is located in a groove 52 in the jet plate 51. Alignment length-wise of the spring is provided by fixing screw 53, or alternatively by a rivet (not shown).

The other end 54 of the spring is engaged beneath a catch portion 55 of an annular rim 56. This arrangement normally maintains the firing pin safe from striking the cap.

A rocket, of which the plate 51 forms one end, is shown in outline as 57. Surrounding the length of the rocket is a launcher 58 having an abutment 59 against which the plate 51 rests. The annular rim 56 normally abuts the other side of the abutment. Accordingly, engagement of the end 54 of the spring with the catch portion of the annular rim normally prevents the rocket falling from the launcher 58.

The launcher has an inner tube 60 and an outer relatively slidable tube 61 having slots 62. Limit stops 63 extend through these slots from the inner tube, thereby delimiting a stroke through which the outer tube can be manually moved with respect to the inner tube.

To fire the cap, and the rocket, the outer and inner tubes are grasped in opposite hands and the rocket is aimed. The outer tube is drawn down thereby flexing the spring as the catch portion 55 withdraws the spring 5 from the jet plate 51. The flexure stress in the spring is reacted via the plate to the abutment 59 and inner tube 60 which continue to locate the rocket. When a certain position of withdrawal is reached the spring, through flexure to an arch shown in FIG. 12, clears the catch portion, and is released. On release the spring has sufficient flexure energy stored therein to drive the firing pin into the cap and fire it. The mass contributes to the firing procedure in ensuring that energy is transferred to the percussion cap at a rate which ensures satisfactory functioning.

For a nominal 40 mm diameter rocket the spring typically may be ½" wide by 20 thou. thick and have an effective length ⅜". It is, of course, important that the end 54 of the spring should clear the abutment 59 on firing.

As can be appreciated, the described firing mechanism is compact, and does not add substantially to the length of the launcher 58. This is of particular advantage, when, as shown, the rocket is spin stabilised—the jet or choke plate having a pair of oblique holes 64—since the rocket and launcher combination is itself compact.

Figure 13:
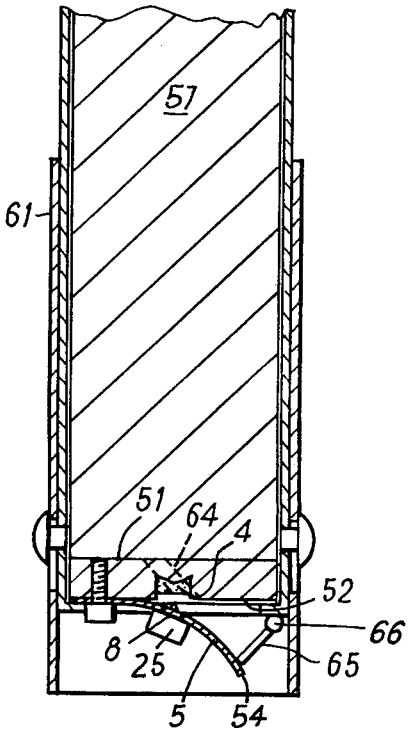
FIG. 13 is a partial view similar to FIG. 9 showing part of an alternative engagement means.

The invention is not intended to be restricted to the details of the above described embodiment. The firing mechanism may have application in rockets other than 40 mm rockets, and indeed in other pyrotechnic percussion initiated devices. Further the details of the means for engaging and withdrawing the spring may be varied. In particular, as shown in FIG. 13 the engagement means may be a catch 65 pivotably mounted in the launcher, e.g. about axis 66, such that pivoting of catch 65 about axis 66 enables the spring 5 to be flexed and released to fire cap 4. Further, the mass 25 might be provided on the other side of the leaf spring 5.

Figure 14:
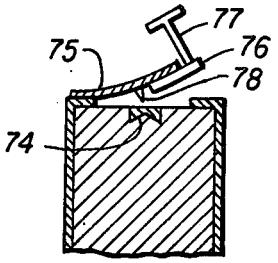
FIG. 14 is a schematic sectional view of another embodiment of the invention.
Figure 12:
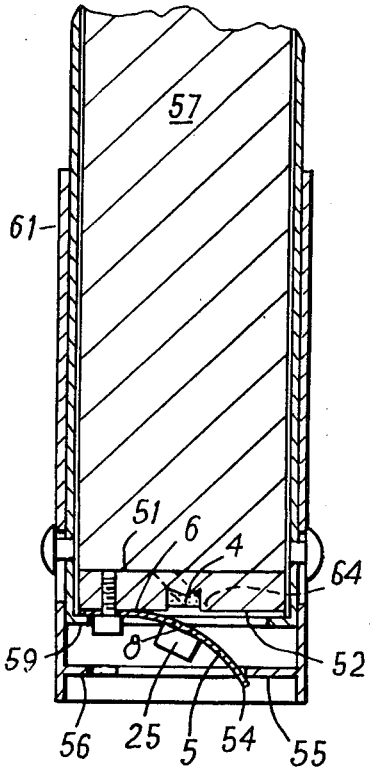
FIG. 12 is a partial view similar to FIG. 9 showing the mechanism immediately prior to firing.

FIG. 14 schematically shows an embodiment wherein a mass 76 is normally positioned to rest beneath the spring 75. When it is desired to fire the cap, a handle 77 attached to the mass 76 is pulled upwardly, thereby flexing the spring 75. When the mass 76 is drawn past the end of spring 75, spring 75 snaps downwardly, and firing pin 78 strikes cap 74. The mass 76 and handle 77 may then be discarded.

I claim:

1. A firing mechanism for firing a percussion cap, said mechanism comprising:
- a percussion cap;
- a percussion cap support having a position in which said percussion cap is located;
- a leaf spring fixed at one end thereof to said support and extending across said percussion cap position;
- a firing pin protruding from one side of said leaf spring towards said percussion cap;
- a mass disposed on said leaf spring to back up said firing pin;
- an engagement device engaged under said leaf spring, on the firing pin side of said leaf spring and at the end thereof opposite from said fixed end, for preventing access of said firing pin to said percussion cap when in the rest position prior to firing; and
- means for withdrawing said engagement device to fire said percussion cap, said withdrawal means being manually actuable to move said engagement device, thereby flexing said spring, to a certain position wherein said engaged end clears said engagement device and there is sufficient energy stored in said spring by flexure that on release of said spring it drives said firing pin into and fires said cap.

2. A firing mechanism according to claim 1, wherein said spring is lightly stressed against said engagement device when in the rest position, but the energy stored in said spring is insufficient to fire said percussion cap in the event of breakage of said engagement device.

3. A firing mechanism as claimed in claim 1, wherein said mass is disposed on the opposite side of said leaf spring from said firing pin.

4. A firing mechanism according to claim 1, wherein said percussion cap support is a housing, said mechanism includes a lever attached to said housing and said engagement device is a catch portion of said lever, said lever being manually operable to flex said spring until said catch portion clears said spring to release said spring and fire said percussion cap.

5. A firing mechanism according to claim 4, wherein said catch portion is constituted by part of said lever itself.

6. A firing mechanism according to claim 4, wherein said lever is flexible and is raised by flexing.

7. A firing mechanism as claimed in claim 4, wherein said lever extends laterally of said leaf spring and said catch portion is a side edge of said lever.

8. A firing mechanism according to claim 4, wherein said lever is rigid and is pivoted with respect to said housing at a pivot axis.

9. A firing mechanism according to claim 4, wherein said lever includes an extension extending beyond said pivot axis, which extension can be depressed to urge said lever proper upwardly.

10. A firing mechanism according to claim 8, wherein said lever is aligned with said leaf spring.

11. A firing mechanism according to claim 10, wherein said lever is pivoted with respect to said housing at a position directly opposite said fixed end of said spring.

12. A firing mechanism according to claim 1, further comprising location means for locating said percussion cap support, flexure stress in said spring being reacted via said percussion cap support to said location means during withdrawal of said engagement device to fire said percussion cap.

13. A firing mechanism according to claim 12, wherein the said percussion cap support is a rocket jet plate and said location means is a rocket launcher.

14. A firing mechanism according to claim 13, wherein said engagement device is a catch pivoted in said launcher.

15. A firing mechanism according to claim 13, further comprising an inner tube; an outer tube which partially surrounds and is slidable relative to said inner tube and which together with said inner tube constitutes said rocket launcher; an abutment provided within said inner tube for said rocket jet plate to abut against prior to firing; and a catch constituting said engagement device within said outer tube for engaging said remote end of said spring.

16. A firing mechanism according to claim 15, wherein said catch is an annular rim secured in said outer tube, the arrangement being such that said spring retains said rocket jet plate on said abutment.

17. A firing mechanism according to claim 13, including means for positively aligning said spring with respect to said rocket jet plate.

18. A firing mechanism according to claim 17, wherein said positive locating means is a groove in said rocket jet plate.

19. A rocket and launcher combination comprising:
- a percussion cap;
- a rocket jet plate having a position wherein said percussion cap is supported;
- a leaf spring fixed at one end thereof to said rocket jet plate and extending across said percussion cap position;
- a firing pin protruding from one side of said leaf spring towards said percussion cap;
- a mass disposed on said leaf spring to back up said firing pin;
- a rocket body having said rocket jet plate at one end thereof;
- a rocket launcher at least partially surrounding said rocket body;
- an engagement device provided in said rocket launcher engaged under said leaf spring, on the firing pin side of said spring and at the end thereof opposite from said fixed end, for preventing access of said firing pin to said percussion cap when in the rest position prior to firing;
- abutment means in said rocket launcher for said rocket jet plate to abut against prior to firing; and
- means in said rocket launcher to allow withdrawal of said engagement device to fire said percussion cap, said withdrawal means being manually actuable to move said engagement device, thereby flexing said spring, flexure stress in said spring being reacted via said rocket jet plate to said abutment means and said rocket launcher, to a certain position wherein said engaged end clears said engagement device and there is sufficient energy stored in said spring by flexure that on release of said spring it drives said firing pin into and fires said cap.

20. A rocket and launcher combination according to claim 19, further comprising an inner tube; an outer tube which partially surrounds and is slidable relative to said inner tube and which together with said inner tube constitutes said rocket launcher; said abutment means being provided with said inner tube for said rocket jet plate to abut against prior to firing; and a catch constituting said engagement device within said outer tube for engaging said engaged end of said spring.

21. A rocket and launcher combination according to claim 20 wherein said catch is an annular rim secured in said outer tube, the arrangement being such that said spring retains said rocket jet plate on said abutment.

22. A rocket and launcher combination according to claim 20, wherein said engagement device is a catch pivoted in said launcher.

* * * * *